US005791354A

United States Patent [19]

Maznik

[11] Patent Number: 5,791,354

[45] Date of Patent: Aug. 11, 1998

[54] RECIPROCATING COMB

[76] Inventor: Gary Maznik, 5827 Grovewood Dr., Mentor, Ohio 44060

[21] Appl. No.: 779,320

[22] Filed: Jan. 6, 1997

[51] Int. Cl.[6] ..... A45D 24/04

[52] U.S. Cl. ..... 132/136; 132/129; 132/126; 132/137

[58] Field of Search ..... 132/126, 129, 132/136, 137, 140, 141, 142, 119, 160

[56] References Cited

U.S. PATENT DOCUMENTS

| | | | |
|---|---|---|---|
| 961,620 | 6/1910 | Krause | 132/136 |
| 1,932,876 | 10/1933 | Agostini | 132/162 |
| 2,463,893 | 3/1949 | Marini | 132/136 |
| 2,513,897 | 7/1950 | Sonntag | 132/136 |
| 3,464,427 | 9/1969 | Abraham | 132/136 |
| 3,603,324 | 9/1971 | Cutrone | 132/136 |

FOREIGN PATENT DOCUMENTS

| | | | |
|---|---|---|---|
| 481709 | 3/1938 | United Kingdom | 132/136 |

*Primary Examiner*—Gene Mancene
*Assistant Examiner*—Philogene Pedro
*Attorney, Agent, or Firm*—Oldham & Oldham Co., L.P.A.

[57] ABSTRACT

A reciprocating comb comprised of a stationary and a sliding comb member. Both the stationary and sliding comb members consist of elongated rectangular bases having teeth extending therefrom and perpendicular to the orientation of the base. The stationary comb member includes a recess running along the base for accepting the corresponding base of the sliding comb member. In the preferred embodiment, magnets embedded within the elongated base of both the stationary and sliding comb members provide for releasable fastening and automatic reciprocation of the stationary and sliding comb members.

17 Claims, 4 Drawing Sheets

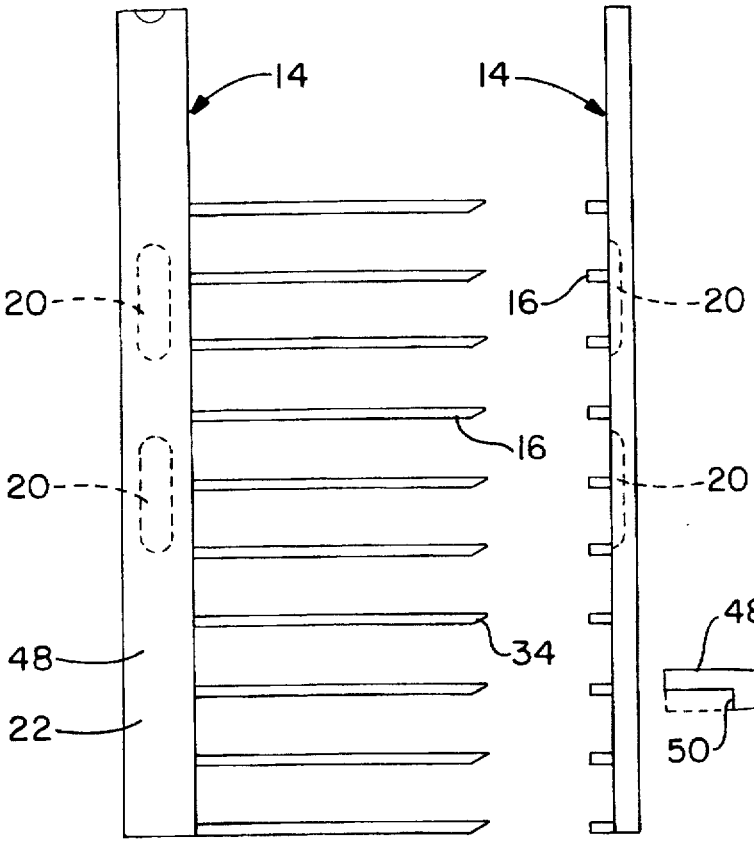
FIG.-7
FIG.-8
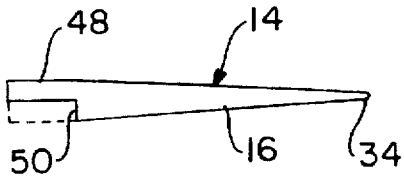
FIG.-9
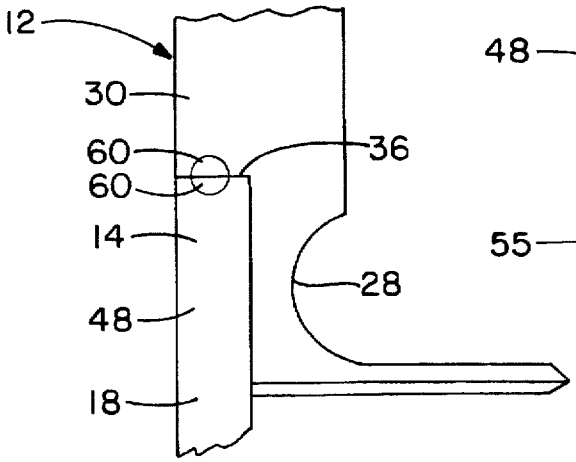
FIG.-13
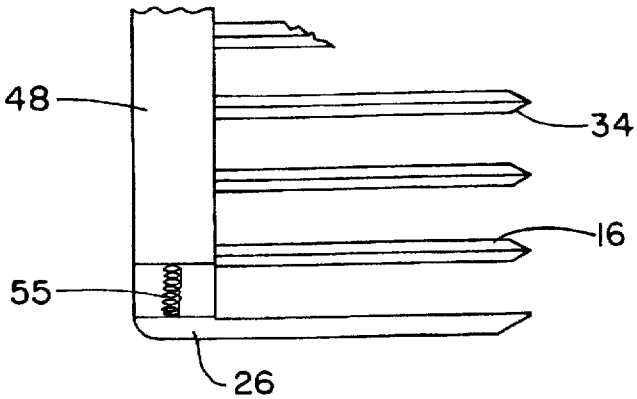
FIG.-14

RECIPROCATING COMB

TECHNICAL FIELD

The present invention relates to combs used in the styling of hair. More specifically, this invention relates to a reciprocating comb for clamping substantial quantities of hair for cutting.

BACKGROUND OF THE INVENTION

Reciprocating combs wherein sets of teeth relative to one another clamp hair in place through a user operated means for cutting are generally known in the art. While generally known in the prior art many drawbacks exist. Typically, the user actuation means which controls the combs reciprocating movement is overly complex requiring many moving parts increasing the cost of the comb and making production more difficult.

As the number of parts required to implement the reciprocating function increases sanitation becomes an increasing problem. Because of the numerous parts, the combs become packed with hair clippings requiring the user to periodically clean the instrument during the cutting procedure. Due to the number of components of the comb cleaning and sterilization is difficult and time consuming. Because sanitary conditions are critical when cutting a person's hair, the user of prior art reciprocating combs had no choice but to spend the extra time needed for cleaning or forego the advantages of the comb all together.

Many prior art reciprocating combs are also bulky and do not compliment the dexterity of the human hand as is now capable through modern ergonomics. As a result, it was difficult to achieve the proper cutting angles when removing hair around the ear, nape, and temple areas of a person. Some of the simpler and less bulky prior art reciprocating combs either did not generate the required tension to clamp substantial quantities of hair for cutting or lacked any tension and required the use of two hands to clamp hair.

Therefore, in light of the foregoing deficiencies in the prior art, the applicant' invention is herein presented.

SUMMARY OF THE INVENTION

The reciprocating comb of the present invention is comprised of a stationary comb member and a sliding comb member. Both the stationary and sliding comb members consist of an elongated base with teeth extending from the base perpendicular to its orientation. The stationary comb member includes a recess or slot running along its base for accepting the corresponding base of the sliding comb member. A releaseable fastening means maintains the cooperative engagement of the stationary and sliding comb members. In the preferred embodiment, magnets embedded within the elongated base of both the stationary and sliding comb members provide the releaseable fastening means. The simplicity of construction and the ease with which the comb members may be separated allows the reciprocating comb to be cleaned quickly and easily thereby providing a more sanitary hair cutting environment. In fact, the ease and speed with which the reciprocating comb can be cleaned promotes more frequent cleaning as the hair stylist's time is not wasted, as it was with reciprocating combs of the prior art.

To provide the comb's means of reciprocation, the stationary comb member's slot is longer than the base of the sliding comb member to which it engages by at least the distance between any two teeth extending from either base. The user manually forces the sliding comb member in either direction until the corresponding teeth of both the stationary and sliding comb members come in contact with one another. The user then introduces the reciprocating comb into a person's hair until the desired amount of hair is within the teeth and then manually forces the sliding comb member in the opposite direction thereby clamping the person's hair tightly between the teeth of the stationary and sliding comb members. The person's hair has now been easily clamped and is ready to be cut in a precise fashion as compared to such methods as the hair stylist using his or her fingers to implement the same clamping action.

While the clamping action of the reciprocating comb can be performed in part manually, the use of magnets to provide a releaseable fastening means in the preferred embodiment can also provide automatic clamping. In order to maintain the engagement of the stationary and sliding comb members, magnets embedded within the elongated bases of each member are positioned in a predetermined location with respect to one another so their magnetic fields attract one another. Whenever the user forces the sliding comb member in one direction the corresponding magnets in both the stationary and sliding comb members become offset from one another. If magnets sufficiently powerful are used, when the user releases the sliding member the magnets pull towards one another thereby moving the sliding comb member in the opposite direction from which the user had directed it. This simple magnetic means of reciprocation allows the user to simply push or pull the sliding comb member with a thumb or finger and release it to achieve the desired clamping action.

Accordingly, it is an object of the present invention to provide a comb which is a further improvement of existing reciprocating combs and which allows easy, simple and reliable clamping, releasing and cutting of substantial quantities of hair in an accurate and safe manner.

It is a further object of the present invention to provide a reciprocating comb with a simple construction that allows and promotes frequent cleaning thereby improving the sanitary condition of the comb.

It is a further object of the present invention to provide a reciprocating comb of simple construction that reduces the cost and labor involved in its manufacturing.

These along with other objects and advantages of the present invention will become more readily apparent from a reading of the detailed description taken in conjunction with the drawings and the claims.

BRIEF DESCRIPTION OF THE DRAWINGS

FIG. 7 is a front elevational view of the sliding comb member which comprises one part of the reciprocating comb of FIG. 1;

FIG. 8 is a left side elevational view of the sliding comb member of FIG. 7;

FIG. 9 is a bottom plan view of the sliding comb member of FIG. 7;

FIG. 13 is an enlarged partial front elevational view of the reciprocating comb of FIG. 1 showing a detailed view of one means of automatic reciprocation;

FIG. 14 is an enlarged partial front elevational view of the reciprocating comb of FIG. 1 showing an alternative means of automatic reciprocation.

DETAILED DESCRIPTION OF THE INVENTION

Figure 1:
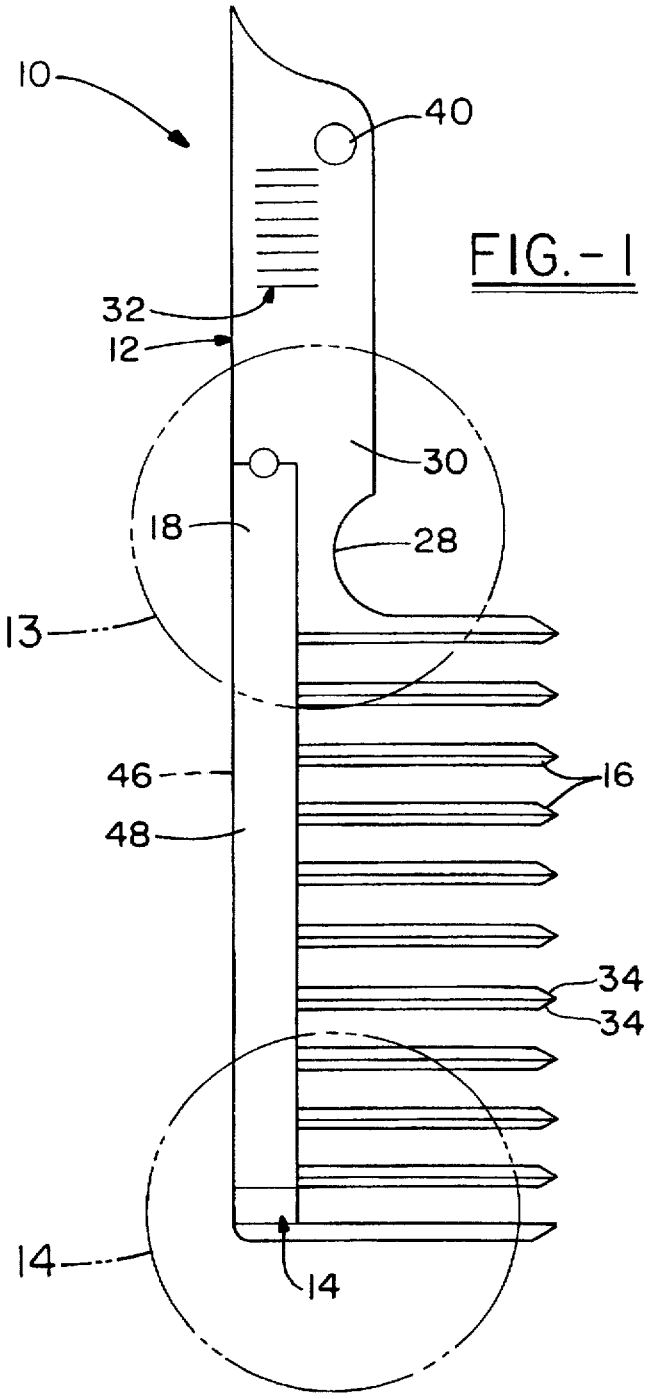
FIG. 1 is a front elevational view of the reciprocating comb in accordance with one embodiment of the present invention.
Figure 2:
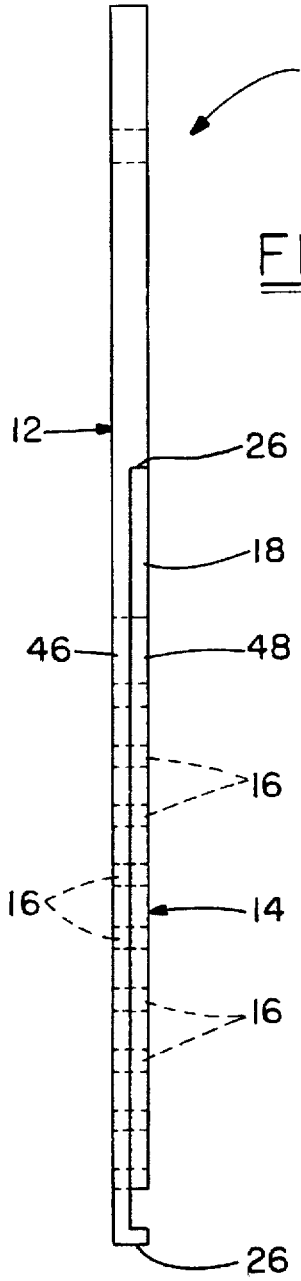
FIG. 2 is a left side elevational view of the reciprocating comb of FIG. 1.
Figure 3:
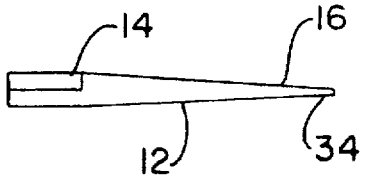
FIG. 3 is a bottom plan view of the reciprocating comb of FIG. 1.

A reciprocating comb 10 in accordance with the preferred embodiment is shown in FIGS. 1 through 3 and comprises stationary comb member 12, sliding comb member 14, and a releasable fastening means. Stationary comb member 12 and sliding comb member 14 each consist of a base, 46 and 48 respectively, from which a plurality of teeth 16 extend perpendicular to the orientation of the associated base, 46 or 48. Sliding member 14 is displaceable within recess 18 formed within stationary member 12 along its base 46.

Figure 4:
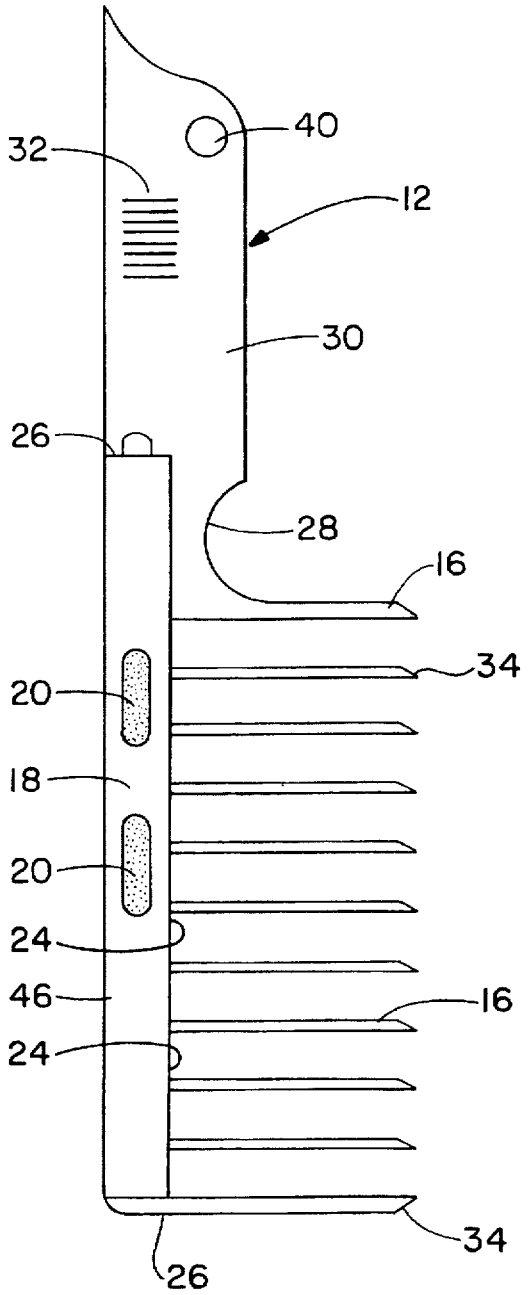
FIG. 4 is a front elevational view of the stationary comb member which comprises one part of the reciprocating comb of FIG. 1.

Stationary member 12 will now be described in more detail with reference to FIGS. 4 through 6. In the preferred embodiment, stationary member 12 is comprised of handle 30 with elongated base 46 extending therefrom having a recess 18 running within base 46 on one of its two sides. Extending from stationary member 12's base 46 are a plurality of teeth 16 spaced apart from one another to provide sufficient gaps in between adjacent teeth 16 to allow hair to be disposed therebetween. Plurality of teeth 16 may, if desired, end with tips 34 which provide each of the plurality of teeth 16 with narrow end points, as shown in FIG. 6, to decreases resistance when reciprocating comb 10 is inserted into a person's hair. Applicant also contemplates plurality of teeth 16 having a V shape which gradually narrow to a point, as shown in FIGS. 3, 6, and 9.

Figure 5:
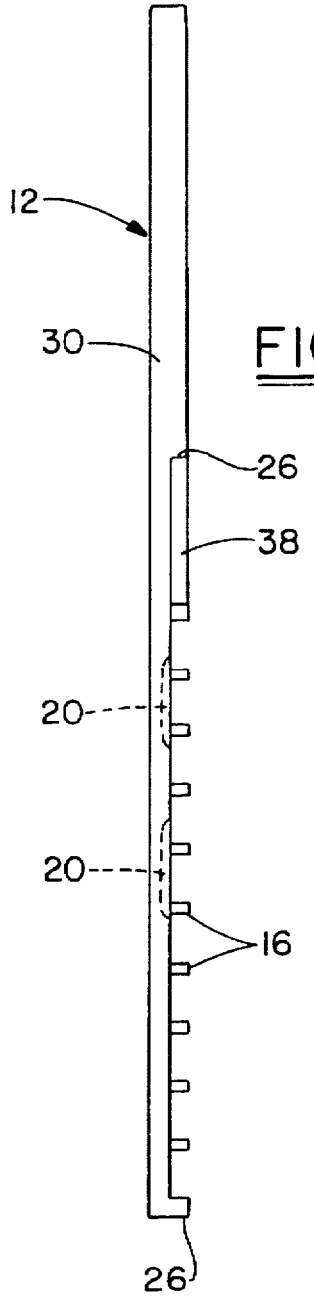
FIG. 5 is a left side elevational view of the stationary comb member of FIG. 4.
Figure 6:
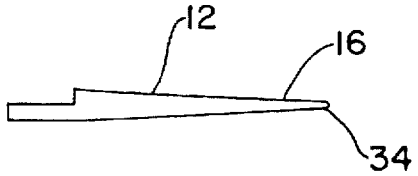
FIG. 6 is a bottom plan view of the stationary comb member of FIG. 4.

With reference to FIG. 5 it can be seen that plurality of teeth 16 are maintained at the same width as that of handle 30 with edge 24 (shown in FIG. 4) of each of plurality of teeth 16 contributing to one edge of recess 18. Embedded within recess 18 of stationary member 12 are plurality of magnets 20. Magnets 20 are embedded deep enough within base 46 of stationary member 12 to maintain the outer face of magnets 20 flush with the surface of recess 18 thereby allowing sliding member 14 to engage the surface of recess 18 of stationary member 12 without interference from magnets 20. Magnets 20 are aligned within base 46 with their magnetic fields polarized identically.

To allow ease of operation of reciprocating comb 10, stationary member 12 includes finger notch 28 located at the end of handle 30 nearest the first of plurality of teeth 16. By placing their index fingers within notch 28, users gain additional control over moving reciprocating comb 10. To further improve control of reciprocating comb 10, grip 32 is embedded in or attached to handle 30. In the preferred embodiment grip 32 is comprised of notches cut within handle 30 and arranged in parallel with one another and in a direction perpendicular to the orientation of handle 30. Other suitable grips also contemplated include rough surfaces similar to the texture of sand paper or any other number of patterns or molded characteristics which would give the surface of handle 30 an inherent resistance to the skin of a persons fingertips. Aperture 40 may also be included to allow the user to hang reciprocating comb 10 from a hook or nail or to attach a string or handle through aperture 40 for the same purpose.

Sliding member 14 of reciprocating comb 10 will now be described in more detail with reference to FIGS. 7 through 9. Sliding member 14 is comprised of elongated base 48 having plurality of teeth 16 extending perpendicularly to the axis of base 48. Plurality of teeth 16 extending from sliding member 14 may also end in sharp tips 34 or be V shaped, as shown in FIG. 7 and FIG. 9. In a similar fashion to that described for stationary member 12, sliding member 14 includes a plurality of magnets 20 embedded within base 48 which cooperate with magnets 20 embedded within stationary member 12 to provide a releaseable fastening means and/or means of automatic reciprocation for reciprocating comb 10. Magnets 20, as shown in FIG. 8, are embedded within sliding member 14 flush with the surface which engages recess 18 of stationary member 12.

Plurality of teeth 16 extending from sliding member 14 are similar to those described for stationary member 12 in that their width is equal to the width of handle 30 of stationary member 12. This can be seen more clearly from FIG. 9 which shows that base 50 of each of plurality of teeth 16, located nearest sliding member 14's base 48, are approximately twice the width of that shown for base 48. Unlike stationary member 12, sliding member 14 has no end stop 26 and base 48 remains the same width throughout its longitudinal axis.

The functional interrelationship of stationary member 12 and sliding member 14 will now be described in more detail again referring to FIGS. 1 through 3. FIG. 1 shows stationary member 12 and sliding member 14 in operable cooperation to form reciprocating comb 10. Sliding member 14 engages with stationary member 12 via recess 18. Base 48 of sliding member 14 is positioned within recess 18 of stationary member 12's base 46 so magnets 20 in both base 46 and 48 face each other and come in contact with one another. Magnets 20 in both stationary member 12 and sliding member 14 are positioned so their polarities cause stationary member 12 and sliding member 14 to be attracted toward each other thereby maintaining the two members in operable contact. While the preferred embodiment comprises two magnets 20 in both stationary member 12 and sliding member 14, Applicant also contemplates many other releaseable fastening means arrangements such as additional magnets, fewer but larger magnets, or one or more magnets in either stationary member 12 or sliding member 14 with only a metallic strip in the other respective member.

Numerous advantages are derived from this releaseable fastening means arrangement. Reciprocating comb 10 can be easily disassembled as the user only has to overcome the magnetic attraction between magnets 20 in stationary member 12 and sliding member 14 to separate reciprocating comb 10 into the two easily cleanable parts. By disassembling reciprocating comb 10 into separate members all crevices in which hair, dirt or other objects may collect are accessible allowing for thorough cleaning and sanitation of reciprocating comb 10. In fact, the ease with which comb members 12 and 14 may be separated and cleaned will serve to promote more periodic cleaning, improving overall hygeine during the hair cutting process.

Figure 10:
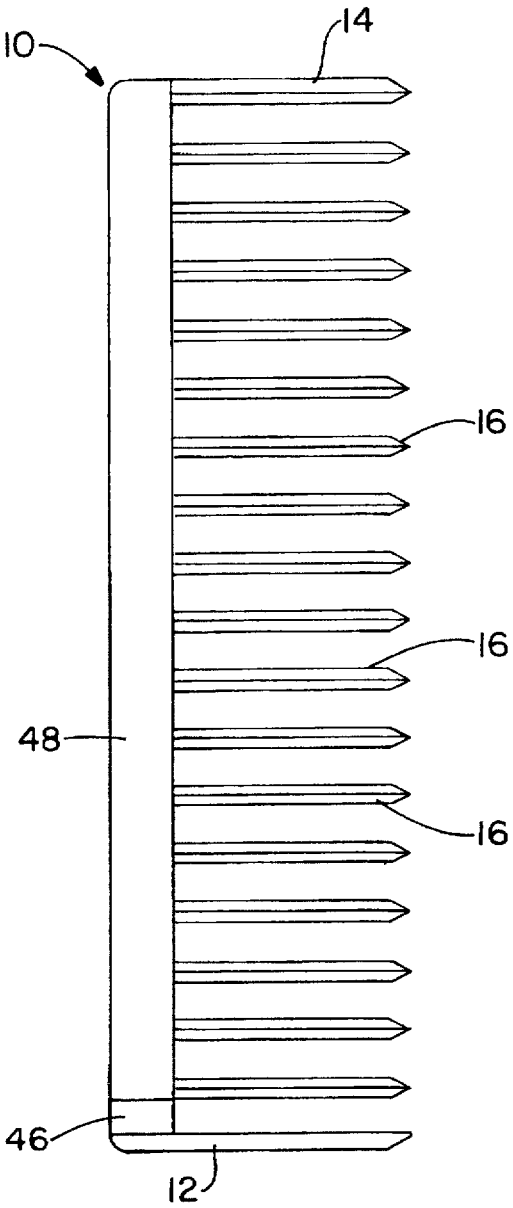
FIG. 10 is a front elevational view of a reciprocating styling comb alternate embodiment of the present invention.
Figure 11:
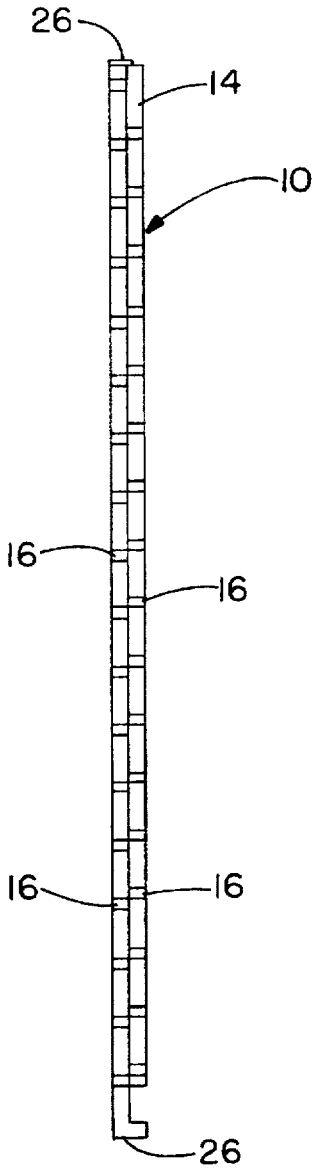
FIG. 11 is a left side elevational view of the reciprocating styling comb of FIG. 10.
Figure 12:
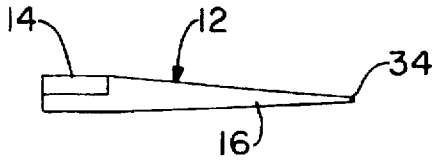
FIG. 12 is a bottom plan view of the reciprocating styling comb of FIG. 10.

An alternate embodiment of the present invention is shown in FIGS. 10 through 12. This embodiment eliminates handle 30 to provide a continuous plurality of teeth 16 extending from bases 46 and 48 of members 12 and 14 respectively to provide a reciprocating styling comb.

The embodiments of reciprocating comb 10 described above requires manual reciprocation of sliding member 14 in both directions. While automatic reciprocation is contemplated, manual reciprocation has several advantages of its own. Automatic reciprocation requires sliding member 14 to be maintained in a default position in one direction or the other in relation to stationary member 12. Manual reciprocation in both directions of sliding member 14 allows greater versatility in how reciprocating comb 10 is used and allows a single embodiment to easily be used by right and left handed hair stylists, rather than having right and left handed embodiments which would require additional steps in the manufacturing process thereby raising costs. As stated, Applicant also contemplates reciprocating comb 10 having a means for automatic reciprocation. To that end, the default position of sliding member 14 within stationary member 12's recess 18 is determined by the positioning of magnets 20 within both stationary member 12 and sliding member 14. FIG. 1 shows sliding member 14 aligned toward handle 30. If magnets 20 are aligned such that this position is the default then to operate reciprocating comb 10 a user forces sliding member 14 in the direction away from handle 30 until sliding member 14 is prevented from any further travel due to its plurality of teeth 16 comming in contact with and being halted by plurality of teeth 16 of stationary member 12. While maintaining sliding member 14 in this position, the user would then insert reciprocating comb 10 into a subjects hair thereby disposing substantial quantities of hair within the gaps formed between plurality of teeth 16. To then achieve the clamping action necessary to continue cutting of the hair, the user releases sliding member 14 thereby allowing the attraction of magnets 20 within stationary member 12 and sliding member 14, which at this point are no longer aligned, to pull sliding member 14 back to its default position and thereby clamp the hair tightly between plurality of teeth 16 With the hair now clamped tightly between plurality of teeth 16 the user may cut the hair in an accurate manner by using scissors to cut along the edge of plurality of teeth 16. To continue, the user simply forces sliding member 14 away from its default position and begins the process over again.

As is apparent, the default position of sliding member 14 could be reversed through simple repositioning of magnets 20 within stationary member 12 and sliding member 14. In fact through this same type of repositioning, the default position of sliding member 14 within stationary member 12 could be such that the spacing of plurality of teeth 16 of sliding member 14 could be set an equal distance between adjacent teeth 16 of stationary member 12 thereby creating, in effect, a normal comb having evenly spaced teeth.

FIG. 13 shows an alternative and/or supplemental means of automatic reciprocation. If additional force is desired during sliding member 14's automatic return to its default position additional magnets 60 may be embedded within end 36 of sliding member 14's base 48 and within handle 30 adjacent to end 36 of sliding member 14. This embodiment is particularly useful if the releaseable fastening means of reciprocating comb 10 is comprised of magnets 20 in either stationary member 12 or sliding member 14, but not both, with a metallic strip in the opposing member. If stationary and sliding members 12 and 14 use a magnetic to metal coupling to provide the releaseable fastening means without the alternative means of reciprocation shown in FIG. 13, no means of automatic reciprocation would exist. As shown in FIG. 14, Applicant also contemplates the use of simple spring biasing 55 between end stop 26 of stationary member 12 and sliding member 14.

While reciprocating comb 10 may be manufactured of a number of different materials such as fiberglass, aluminum, metal, wood or graphite, the preferred embodiments of stationary member 12 and sliding member 14 are comprised of molded plastic with the associated magnets 20 embedded therein. Applicant further contemplates an embodiment in which the magnets are completely encapsulated by the plastic. By using plastic in this manner reciprocating comb 10 essentially consists of only two plastic components as far as the user is concerned. As long as the plastic encapsulation of magnets 20 is not too thick the magnetic force will penetrate through the plastic and maintain the coupling of the opposing comb members. Cleaning and maintenance are simplified in that magnets 20 are not exposed to cleaning solution nor are gaps between the different comb members and magnets 20 exposed to dirt and/or hair clippings. The use of plastic also provides a cheap and simple material for manufacturing reciprocating comb 10 thereby keeping the cost to the consumer to a minimum.

It is to be understood that variations of materials, configurations and applications of the present invention are intended to fall within the scope of the claimed invention and that the subject invention is not to be limited by the specific apparatus or method of operation described and/or depicted by the drawings nor is the invention to be limited by the specific materials and mechanical components identified and described herein. These have been designated merely to provide a demonstration of operability and the selection of mechanically equivalent arrangements is not deemed a departure from the spirit of the invention being limited solely by the scope of the attached claims.

What is claimed is:

1. A reciprocating comb comprising:

a stationary member having an elongated base with a recess formed therein, said base of said stationary member having a plurality of teeth extending therefrom perpendicular to said base; and a sliding member having an elongated base, said base of said sliding member having a plurality of teeth extending therefrom perpendicular to said base; and at least one magnet and at least one corresponding metallic member, wherein said at least one magnet is coupled to said base of one of said members and said at least one corresponding metallic member is coupled to said base of said remaining member;

wherein said base of said sliding member engages said recess of said stationary member to provide operative coupling between said stationary and sliding members allowing said sliding member to reciprocate within said recess when force is applied to said sliding member; and wherein said at least one magnet and at least one corresponding metallic member provide a releasable fastening means to maintain said stationary and said sliding members in operative coupling while allowing said members to be separated if desired thereby allowing for simplified and thorough cleaning.

2. A reciprocating comb as recited in claim 1, wherein said stationary member includes two end stops extending from opposite ends of said base of said stationary member which prevents said sliding member from reciprocating beyond said end stops.

3. A reciprocating comb as recited in claim 1, wherein said at least one magnet and said at least one metallic member are embedded sufficiently within said respective stationary and sliding members to prevent interference during reciprocation of said sliding member within said recess of said stationary member.

4. A reciprocating comb as recited in claim 1 wherein said at least one magnet and at least one corresponding metallic member are positioned within said stationary and sliding members so when said sliding member is reciprocated in one direction within said stationary member, said at least one magnet and said at least one metallic member are sufficiently separated from one another that when the force applied to said sliding member enabling reciprocation of said comb is released the magnetic attraction of said at least one magnet to said at least one metallic member causes said sliding member to return to the starting position of said sliding member in relation to said stationary member, thereby providing a means of automatic reciprocation.

5. A reciprocating comb as recited in claim 1, further comprising, at least two magnets wherein at least one of said magnets is coupled to said base of said stationary member and at least one of said magnets is coupled to said base of said sliding member wherein said magnets of said members are aligned so the magnetic fields of said magnets in said opposing stationary and sliding members attract one another thereby providing a releaseable fastening means to maintain said stationary and said sliding members in operative coupling while allowing said members to be separated if desired thereby allowing for simplified and thorough cleaning.

6. A reciprocating comb as recited in claim 5, wherein at least one of said magnets is embedded sufficiently within said stationary member and at least one of said magnets is embedded sufficiently within said sliding member to prevent interference during reciprocation of said sliding member within said recess of said stationary member.

7. A reciprocating comb as recited in claim 5, wherein said at least two magnets, wherein at least one of said magnets is coupled to said base of said stationary member and at least one of said magnets is coupled to said base of said sliding member, are positioned within said stationary and sliding members so that when said sliding member is reciprocated in one direction within said stationary member, said at least two magnets are sufficiently separated from one another that when the force applied to said sliding member enabling its reciprocation of said comb is released, the magnetic attraction between said at least two magnets causes said sliding member to return to starting position of said sliding member in relation to said stationary member thereby providing a means of automatic reciprocation.

8. A reciprocating comb as recited in claim 1, wherein said plurality of teeth extending from said base of said stationary member and said base of said sliding member are wider than said base of said corresponding stationary sliding member, wherein during reciprocation of said sliding member within said stationary member, said width of said plurality of teeth causes said plurality of teeth extending from said base of said sliding member to contact and interfere with said plurality of teeth extending from said base of said stationary member, thereby limiting the distance in which said sliding member can reciprocate.

9. A reciprocating comb as recited in claim 1, wherein, said stationary member and said sliding member are fabricated from plastic; and said at least one magnet and at least one metallic member are embedded within said base of said corresponding stationary and sliding members where said at least one magnet and said at least one metallic member are completely encapsulated within said plastic of said corresponding stationary and sliding member.

10. A reciprocating comb as recited in claim 5, wherein, said stationary member and said sliding member are fabricated from plastic; and said at least two magnets wherein at least one of said magnets is coupled to said base of said stationary member and at least one of said magnets is coupled to said base of said sliding member are completely encapsulated within said plastic of said corresponding stationary and sliding member.

11. A reciprocating comb as recited in claim 1, further comprising a handle extending from one end of said base of said stationary member which provides a convenient position for a user to hold said reciprocating comb and provides the user with additional control while manipulating said reciprocating comb.

12. A reciprocating comb as recited in claim 11, wherein said handle includes a grip which provides a resistive surface preventing said handle from slipping from a users hand.

13. A reciprocating comb as recited in claim 1, wherein said stationary member and said sliding member are fabricated from one of the group consisting of plastic, fiberglass, aluminum, metal, wood, and graphite.

14. A reciprocating comb as recited in claim 1, further comprising an automatic reciprocation means consisting of a spring positioned between corresponding ends of said base of said stationary member and said base of said sliding member such that when said sliding member is reciprocated in one direction within said stationary member, said spring is compressed creating a force upon said sliding member opposite that of the direction of reciprocation so that when the force applied to said sliding member enabling reciprocation is released, said spring's compression forces said sliding member to return to the starting position of said sliding member in relation to said stationary member.

15. A reciprocating comb as recited in claim 1, wherein said plurality of teeth extending from said stationary and said sliding members include tips at the ends of said teeth which decrease resistance encountered from a person's hair when said reciprocating comb is used.

16. A reciprocating comb as recited in claim 1, wherein said plurality of teeth extending from said stationary and said sliding members are somewhat V shaped with their widest portion positioned directly adjacent said base of said corresponding stationary and sliding member, and wherein said plurality of teeth end in a narrower width than said width directly adjacent said corresponding base.

17. A method of using the reciprocating comb recited in claim 1 comprising the steps of, placing said reciprocating comb in a users hand;

introducing said reciprocating comb into a person's hair until a desired amount of said hair is within said plurality of teeth of said reciprocating comb;

manually forcing said sliding member in one direction thereby clamping said person's hair tightly between said plurality of teeth of said stationary and said sliding members;

cutting said person's hair along the edge of said plurality of teeth in a precise fashion;

removing said manual force from said sliding member thereby releasing said person's hair from between said plurality of teeth of said stationary and said sliding members; and repeating the previously recited steps.

* * * * *